US006186234B1

(12) United States Patent
Hailey

(10) Patent No.: US 6,186,234 B1
(45) Date of Patent: Feb. 13, 2001

(54) REMOVAL OF LINING FROM TUBING

(76) Inventor: Charles D. Hailey, 11628 Burning Oaks, Oklahoma City, OK (US) 73150

( * ) Notice: Under 35 U.S.C. 154(b), the term of this patent shall be extended for 0 days.

(21) Appl. No.: 09/584,954

(22) Filed: Jun. 2, 2000

Related U.S. Application Data

(62) Division of application No. 09/256,021, filed on Feb. 23, 1999.

(51) Int. Cl.[7] ..... E21B 29/00

(52) U.S. Cl. ..... 166/298; 166/55.3; 166/243; 166/377

(58) Field of Search ..... 166/298, 277, 166/377, 55.3, 55, 243, 207, 206, 242.2

(56) References Cited

U.S. PATENT DOCUMENTS

| | | | | |
|---|---|---|---|---|
| 1,739,601 | | 12/1929 | Marble | 294/86.12 |
| 1,789,993 | * | 1/1931 | Switzer | 166/55.3 |
| 2,705,998 | * | 4/1955 | Spang | 166/55.3 |
| 2,886,369 | | 5/1959 | Decuir | 294/86.12 |
| 2,915,127 | | 12/1959 | Abendroth | 166/99 |
| 2,984,302 | | 5/1961 | Church | 166/98 |
| 3,727,692 | | 4/1973 | Kinley et al. | 166/297 |
| 3,750,748 | | 8/1973 | Kinley et al. | 166/277 |
| 5,074,355 | * | 12/1991 | Lennon | 166/55.1 |
| 5,078,546 | * | 1/1992 | Fisk et al. | 405/156 |
| 5,306,101 | * | 4/1994 | Rockower et al. | 405/154 |

* cited by examiner

*Primary Examiner*—Hoang Dang
(74) *Attorney, Agent, or Firm*—McAfee & Taft

(57) ABSTRACT

A cutting tool and a rotatable removal tool can be used together in a system and method for removing lining from tubing in a well. A particular cutting tool includes a mandrel, a sleeve mounted on the mandrel, and a cutting member connected to the sleeve. The cutting member has a width and a cutting edge of angular disposition to form a beveled cut through the lining. Setoff members can be used to space the sleeve from the lining and to engage the lining to enable relative rotation between the mandrel and the sleeve when the cutting tool is in the lining. A particular removal tool includes an inner engagement member and an outer engagement member. The two engagement members are connected such that lining is drawn into and held between them in response to rotating at least the inner engagement member within the lining. A particular engagement member includes a bulbous body adapted to twist into lining in response to rotating the bulbous body in the lining. Another particular engagement member includes a cylindrical body having a wall defining a cavity, the wall defining inner and outer diameters substantially equal to nominal inner and outer diameters of the lining. The wall can have a lower end to cut into and engage a facing end surface of the lining. The wall can have an inner surface in at least a portion of which a ridge is defined.

12 Claims, 4 Drawing Sheets

REMOVAL OF LINING FROM TUBING

This application is a divisional of co-pending Application Ser. No. 09/256,021, filed on Feb. 23, 1999.

BACKGROUND OF THE INVENTION

This invention relates generally to apparatus and methods for removing lining from tubing. In a particular aspect, this invention relates to removing polyurethane lining from casing used in wells.

In constructing a well from which liquid or gas is to be produced, various types of tubing strings can be put in the drilled borehole. One type is typically called "casing." Traditionally this has been a metal tubing having a relatively large inner diameter that allows other tubing strings to be lowered through it. One way to use casing is to lower it into the borehole and then pump cement such that the cement is placed in the annulus between the casing and the wall of the borehole. These operations are performed using well-known techniques.

Another type of tubing string that has been used is a smaller diameter string that is run into the well inside previously installed casing. Such a narrower string might be used to produce oil or gas from the well to the surface, for example. Another example is that such a string might be used to inject substances into the well, such as in a technique referred to as "secondary recovery" in which the injected substance pushes hydrocarbons out of the well (or out another well or other wells).

More recently, a different type of casing has been used in some applications. This type of casing includes the traditional metal tubing, but one lined with plastic. The plastic lining is typically made of a thermoplastic polymer, a non-limiting example of which is polyurethane. With this type of casing, some substances can be produced from or injected into a well without the use of the traditional inner production or injection tubing string referred to in the immediately preceding paragraph. The inner diameter of the lined casing is larger than the inner diameter of the traditional production or injection tubing; therefore, more production or injection per unit of time can be obtained through the lined casing alone than through the narrower traditional production or injection string. That is, higher volumetric flow rates can be obtained through the lined casing. This type of casing has been used, for example, in producing gaseous carbon dioxide from a first well and in injecting it into a second well in a secondary recovery process for driving liquid or gaseous hydrocarbons out of the second well or out of the formation intersected by the second well.

The lined casing application referred to above, in which no separate inner tubing string is used, has advantages over the traditional casing plus production/injection string technique. In addition to the larger flow advantage mentioned above, the lined casing can be used less expensively. Furthermore, the lining is more resistant to corrosion than the metal casing. Such lining can be used to cover damaged casing walls.

Although there are at least the aforementioned advantages, the plastic lining can be damaged during installation and sometimes the metal casing may corrode or deteriorate sufficiently that it needs to be repaired even though it may be covered by the lining. When this damage or deterioration occurs, the lining needs to be pulled out of the outer metal tubing and a new lining installed (and possibly repairs made to damaged metal tubing). Although the outer metal tubing is typically cemented into the well borehole, the lining is retained in the metal tubing by its own outwardly directed force and friction. That is, the lining is not glued or otherwise separately adhered to the metal tubing. Rather, the lining is inserted in known manner into the metal tubing in a radially inwardly compressed state; once installed, the resilient lining (having an uncompressed outer diameter larger than the inner diameter of the metal tubing) expands against the inner surface of the metal tubing so that the lining is held by the radially outward force exerted by the lining and friction between the outer surface of the lining and the inner surface of the tubing. At the mouth of the well, a plastic flange is fused to the upper end of the lining to also provide support. In view of the foregoing reasons why lining sometimes needs to be removed, and since the outer metal tubing is cemented in the borehole, there are the need for a system and method for removing lining from the tubing and the need for components for such system and method.

SUMMARY OF THE INVENTION

The present invention meets the aforementioned needs by providing a novel and improved system and method for removing lining from tubing, particularly tubing in a well. A novel and improved cutting tool and a novel and improved removal tool and method for use in removing lining from tubing are also provided. Novel and improved engagement members used in particular implementations of the foregoing are also provided.

The system for removing lining from tubing in a well comprises a cutting tool and a rotatable removal tool. The cutting tool has a cutting member to cut lining while the lining is in tubing in the well. The rotatable removal tool engages the cut lining in the well such that a portion of the cut lining is twisted into engagement with the removal tool for extraction from the well with extraction of the removal tool from the well.

The method of removing lining from tubing in a well comprises: cutting lining disposed in a tubing disposed in a well; rotating an inner retaining body into an inner surface of the cut lining; and pulling on the inner retaining body to remove the cut lining from the tubing. Another definition of the present invention for a method of removing lining from tubing for a well comprises: engaging lining in tubing for a well, including twisting a portion of the lining and holding the twisted portion; and pulling on the twisted and held portion of the lining. Still another definition states that a method of removing lining from tubing for a well comprises: rotating an inner retaining body into an inner surface of lining in tubing for a well; and pulling on the inner retaining body to remove the lining from the tubing.

A cutting tool that can be used in the aforementioned system and method comprises: a mandrel and a sleeve mounted on the mandrel such that there is selectable relative movement between the mandrel and the sleeve. This cutting tool also comprises a cutting member connected to the sleeve such that the cutting member is in a retracted position when the mandrel and the sleeve are in a first relative position and such that the cutting member is in an extended position when the mandrel and the sleeve are in a second relative position. The cutting member has a width and a cutting edge of angular disposition sufficient to form a beveled cut through a plastic lining in a tubing in the well where the cutting tool is pulled through the lining with the cutting member in the extended position. This cutting tool can further comprise setoff members disposed around the exterior of the sleeve to space the sleeve from the lining and to engage the lining to enable relative rotation between the mandrel and the sleeve when the cutting tool is disposed in the lining.

A removal tool that can be used to remove lining from tubing comprises an inner engagement member and an outer engagement member. The outer engagement member connects to the inner engagement member such that lining in a tubing is drawn into and held between the inner engagement member and the outer engagement member in response to rotating at least the inner engagement member within the lining.

Another definition of a removal tool of the present invention states that the tool comprises: a shaft adapted to connect to a tool string for being moved into and out of an oil or gas well; an inner body connected to the shaft, the inner body having outer surface means for twisting into an inner surface of lining in tubing in response to rotation of the shaft when the tool is disposed in the tubing; and an outer body connected to the shaft such that the outer body is slidable relative to the shaft but rotates with the shaft when the shaft is rotated, the outer body disposed relative to the inner body such that lining moves between the inner body and the outer body when the outer surface means of the inner body twists into the inner surface of the lining.

An engagement member that can be used for the tool for removing lining from tubing comprises a bulbous body having an outer surface adapted to twist into an inner surface of lining in tubing in response to rotation of the bulbous body when the body is disposed in the lining.

Another engagement member that can be used for the tool for removing lining from tubing comprises a cylindrical body having a wall defining a cavity, the wall defining inner and outer diameters substantially equal to nominal inner and outer diameters of lining in tubing. The wall can terminate at a lower end adapted to cut into and engage a facing end surface of the lining. The wall can have an inner surface in at least a portion of which a ridge is defined.

An advantage of the present invention is that it enables lining to be removed from the surrounding metal tubing without removing the tubing (which is typically cemented in the well).

Therefore, from the foregoing, it is a general object of the present invention to provide a novel and improved system and method for removing lining from tubing, particularly tubing in a well. It is also a general object to provide a novel and improved cutting tool and a novel and improved removal tool and method for use in removing lining from tubing. It is still another general object of the present invention to provide novel and improved engagement members used in particular implementations of the foregoing. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is an elevational view of a removal tool of the present invention.

DETAILED DESCRIPTION OF THE INVENTION

Figure 1:
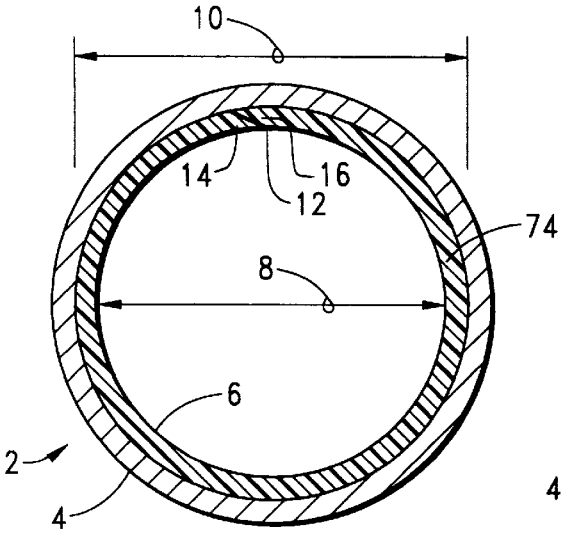
FIG. 1 is a cross-sectional plan view of a casing having a thermoplastic polymer lining in a metal tubing, wherein the lining has been cut by a cutting tool of the present invention.
Figure 2:
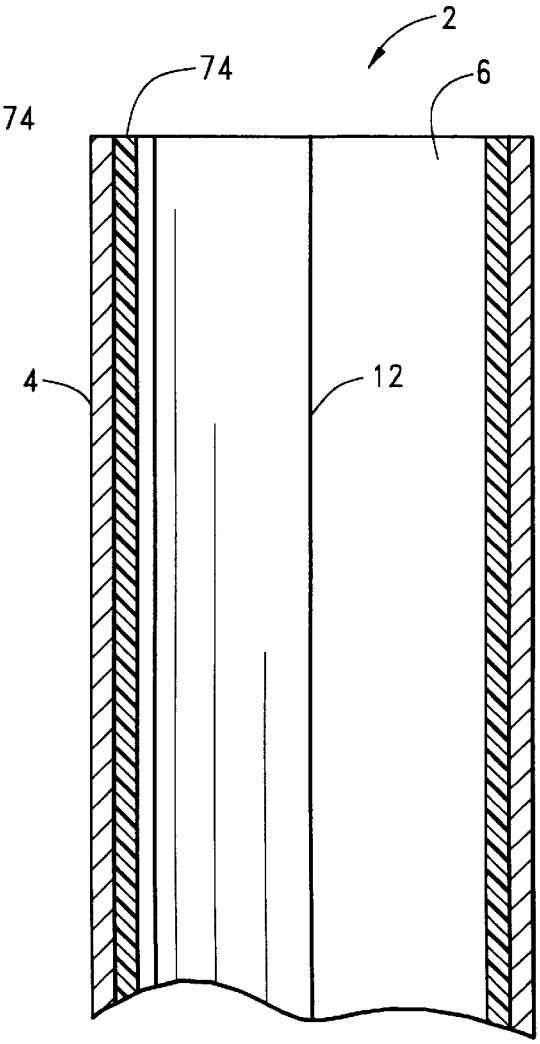
FIG. 2 is a cross-sectional elevational view of the casing shown in FIG. 1.

Referring to FIGS. 1 and 2, a casing 2 includes an outer metal tubing 4 and an inner plastic lining 6 made in a known manner as described above. Accordingly, the lining 6 is susceptible of being pulled out of the metal tubing 4. Both the metal tubing 4 and the plastic lining 6 are made of suitable materials known in the art; but since it is the lining 6 that is to be cut and/or removed by the present invention, it is specifically noted that the plastic material of the lining 6 is typically a thermoplastic polymer. A particular type of this material used in the oil and gas industry for the liner 6 is polyurethane.

The typical cross-sectional shape of the tubing 4 and the lining 6 is circular. The tubing 4 and the lining 6 have respective inner and outer surfaces which define respective inner and outer diameters. An inner diameter 8 and an outer diameter 10 of the lining 6 are marked in FIG. 1, for example.

Also shown in FIGS. 1 and 2 is a cut 12 in the lining 6. As illustrated in FIG. 2, the cut 12 is longitudinal through the portion of the lining 6 in which the cut 12 is formed. As illustrated in FIG. 1, the cut 12 is beveled (i.e., it is not radial through the wall of the lining 6). The angle of the bevel is such that when a suitable rotative force is applied to the cut lining 6, the surface of a cut end 14 slides along the facing surface of a cut end 16 and the cut end 14 moves inside the cut end 16. This twisting of the lining 6 reduces the inner and outer diameters 8, 10. The angle of the bevel of the cut 12 shown in FIG. 1 optimally responds to a clockwise (as looking into FIG. 1) twisting. How this occurs in the preferred embodiments of the present invention is described below. The bevel could be formed in the other direction to respond to a counterclockwise force, such as applied in accordance with the following description but modified for counterclockwise operation.

The foregoing cutting and twisting, and the ultimate removal, of the lining 6 can be accomplished using the system and method of the present invention as well as inventive elements of the system and method. Although the system and method can be implemented in any suitable manner, non-limiting implementations can include the inventive elements which include a particular cutting tool, a particular removal tool, and particular engagement members that can be used in the removal tool.

The overall system for removing lining from tubing in a well in accordance with the present invention comprises both a cutting tool and a removal tool. The cutting tool cuts at least a portion of the lining while the lining is in tubing in the well. In a particular application, the cutting tool has a cutting member adapted to form a beveled cut (e.g., the beveled cut 12 in FIGS. 1 and 2) through a thermoplastic polymer wall of a lining along a length of the lining as the cutting tool disposed in a cutting mode is pulled through such length of the lining.

The removal tool of the system is rotatable to engage the cut lining in the well such that a portion of the cut lining is twisted into engagement with the removal tool for extraction from the well with extraction of the removal tool from the well. In particular, the removal tool is adapted to twist into and hold the cut thermoplastic polymer wall of the lining such that the cut thermoplastic polymer wall is removed from the tubing in response to pulling the removal tool out of the well.

A particular cutting tool of the present invention and a particular removal tool of the present invention are illustrated in FIGS. 3–5 and FIGS. 6–10, respectively.

Figure 3:
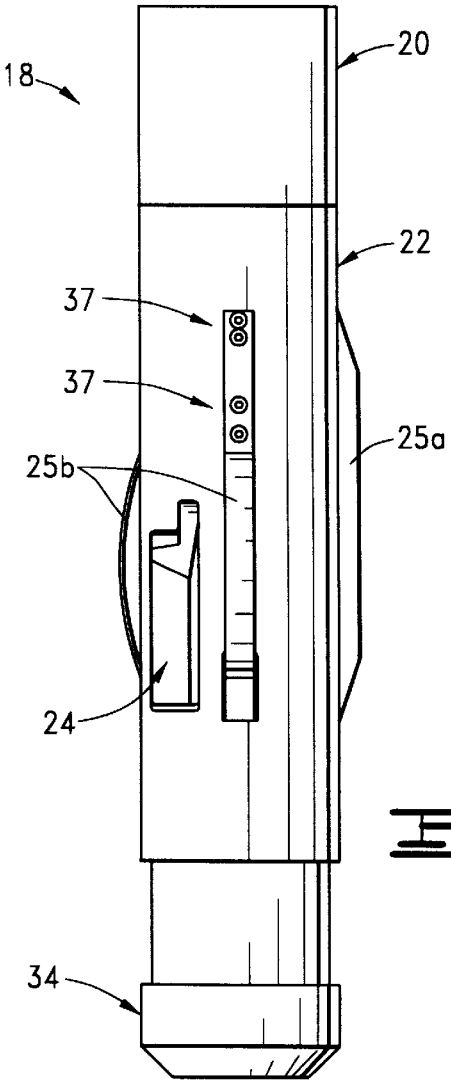
FIG. 3 is an elevational view of a cutting tool of the present invention.
Figure 4:
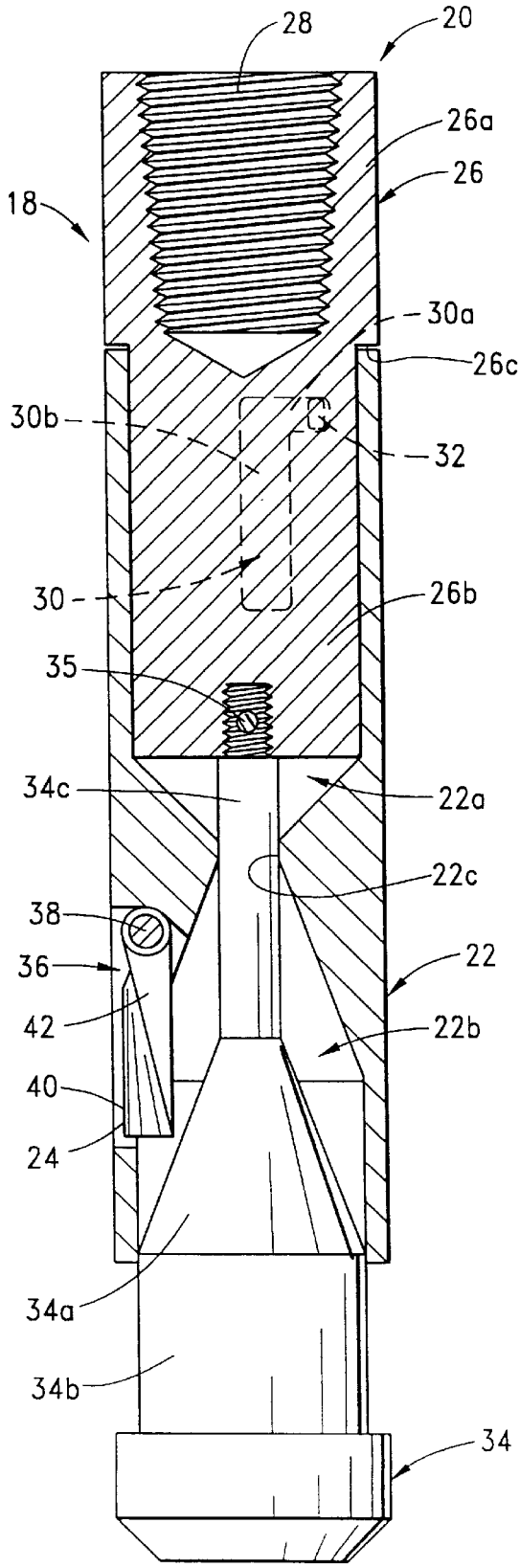
FIG. 4 is a cross-sectional elevational view of the FIG. 3 cutting tool in which the cutting member is in a retracted position.
Figure 5:
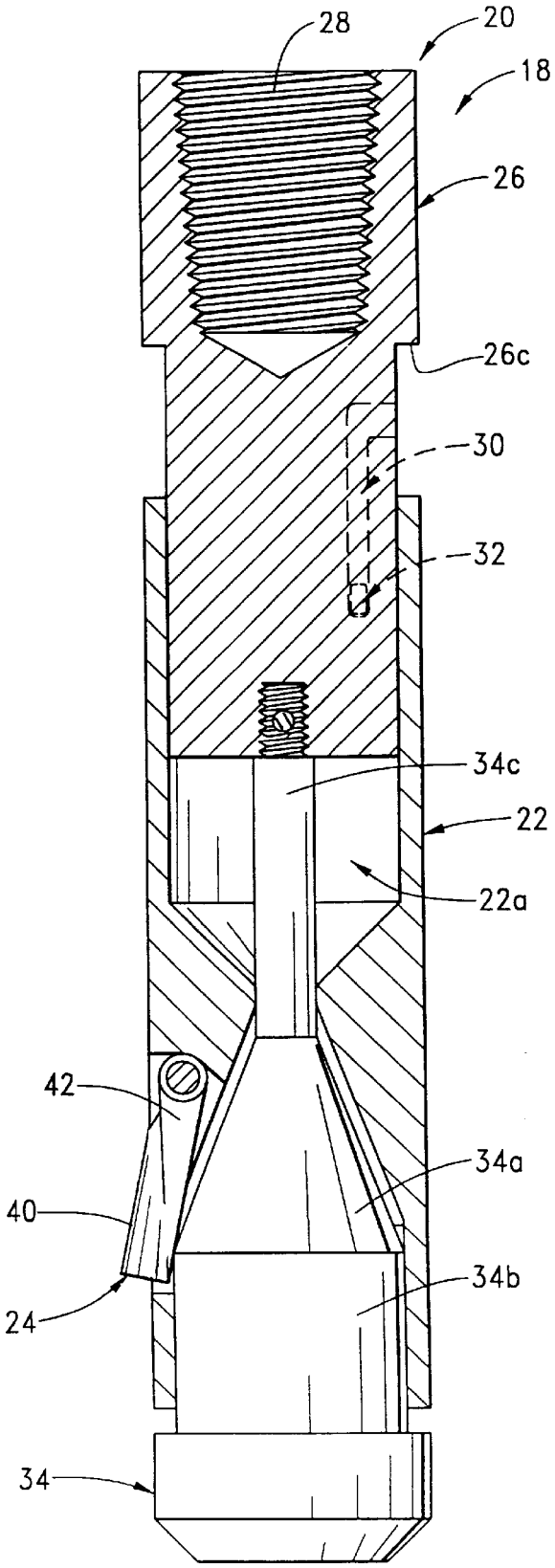
FIG. 5 is a cross-sectional elevational view of the FIG. 3 cutting tool in which the cutting member is in an extended position.

Referring first to FIGS. 3–5, the cutting tool is generally designated by the reference number 18. The cutting tool 18 comprises a mandrel 20, a sleeve 22, a cutting member 24, and setoff members 25 (different types designated 25*a* and 25*b* as described below).

The mandrel 20 shown in FIGS. 4 and 5 includes an adapter body 26 to connect to a conventional tool string. The adapter body 26 has a cylindrical upper portion 26*a* having an outer diameter larger than the outer diameter of a cylindrical lower portion 26*b* of the adapter body 26. An annular shoulder 26*c* extends radially between the portions 26*a*, 26*b*. The upper portion 26*a* has a threaded inner surface 28 of a cavity in which to receive a complementally shaped end of the tool string used for running the cutting tool 18 into and out of the well and the channel defined through the lining 6.

The lower portion 26*b* of the adapter body 26 has a slot 30 defined in it. The slot 30 has a circumferential segment 30*a* and a longitudinal segment 30*b* joined to define a continuous track for a pin 32 attached to the sleeve 22. With the pin 32 in the segment 30*a* as illustrated in FIG. 4, the upper end of the sleeve 22 is adjacent the shoulder 26*c* of the adapter body 26 and the cutting member 24 is in a retracted position. When the pin 32 is in the lower end of the slot segment 30*b* as illustrated in FIG. 5, the sleeve 22 is in a lowered position relative to the position shown in FIG. 4 and the cutting member 24 is in an extended, cutting position. The initial, run-in position of the pin 32 is that shown in FIG. 4. To shift to the cutting position for the cutting member 24, the tool string to which the adapter body 26 is connected is rotated clockwise (as looking into the well from the surface and for the particular illustrated implementation of the slot 30 and pin 32) so that the slot segment 30*a* rotates relative to the pin 32 whereby the pin 32 enters the elbow at the junction of the slot segments 30*a*, 30*b*. The tool string is then raised to move the slot segment 30*b* relative to the pin 32 until the position shown in FIG. 5 is obtained.

The result of the foregoing action is to move the cutting member 24 outwardly to its extended, cutting position. This result is obtained because the mandrel 20 also includes an actuator body 34 having an angled surface 34*a* to engage the cutting member 24 and move the cutting member 24 to the extended position. The angled surface 34*a* has an upper portion closer to a longitudinal axis of the mandrel 20 than is a lower portion of the angled surface 34*a*. That is, the surface 34*a* has a conical shape that tapers outwardly from top to bottom for the orientation shown in FIGS. 4 and 5.

The actuator body 34 extends below the portion with the tapered surface 34*a*. This lower portion 34*b* has a cylindrical shape with an outer diameter slightly less than the inner diameter of the adjacent surface of the sleeve 22 so that the portion 34*b* of the actuator body 34 maintains alignment with the sleeve 22 during the relative longitudinal movement between the mandrel 20 and the sleeve 22 described above. Similar alignment is also obtained between an upper portion 34*c* of the actuator body 34 and an adjacent portion of the sleeve 22 as apparent in FIGS. 4 and 5. The upper portion 34*c* is a shaft that at its upper end is threaded to couple with a complementary threaded cavity in the adapter body 26. A pin 35 secures the connection against the rotative action that can be imparted during slot 30/pin 32 operation.

As apparent from the description above, the sleeve 22 is mounted on the mandrel 20 such that there is selectable relative circumferential and longitudinal movement between the mandrel 20 and the sleeve 22. This selectable movement occurs via the operation involving moving the slot 30 relative to the pin 32. The sleeve 22 is a cylindrical member bored, milled or otherwise suitably formed such that communicated cavities are defined in both ends. An upper cavity 22*a* and a lower cavity 22*b* (as oriented in FIGS. 4 and 5) are shown in FIGS. 4 and 5. The cavity 22*a* is sized and shaped to receive in close alignment the lower portion 26*b* of the adapter body 26. The cavity 22*b* is sized and shaped to receive in close alignment the angled surface 34*a* and the lower portion 34*b* of the actuator body 34. These relationships are apparent in FIGS. 4 and 5. The sleeve 22 also has an opening defined by surface 22*c*; this opening connects or communicates the cavities 22*a*, 22*b*. The opening at surface 22*c* is sized and shaped to receive in close alignment the upper portion 34*c* of the actuator body 34. "Close alignment" includes sufficient tolerances to allow relative sliding movement to occur while also maintaining a guiding or aligning relation between the adjacent moving structures.

The sleeve 22 also has a radial opening 36 defined through the wall of the sleeve between its exterior surface and the cavity 22*b*. The radial opening 36 has the cutting member 24 pivotally mounted in it as shown in FIGS. 4 and 5 (i.e., a pin 38 is inserted through the wall of the sleeve 22 and through an eye of the cutting member 24).

The cutting member 24 has a width and a cutting edge of angular disposition sufficient to form the beveled cut 12 described above with the desired angle. The width referred to is the lateral dimension in the plane of the sheet containing FIGS. 4 and 5. The cutting edge is identified in FIGS. 4 and 5 by the reference number 40. The cutting edge 40 extends at the desired angle for obtaining the beveled cut 12. It so extends from a body portion 42 that engages the angled surface 34*a* of the actuator body 34 of the mandrel 20 when the mandrel 20 and the sleeve 22 move relative to each other to the FIG. 5 position in which the cutting member 24 is moved to its extended position. It is noted that other cutting configurations can be used (e.g., V-cut, radial cut, etc.); however, preferred cuts are those that facilitate twisting of the cut lining in response to the rotative force applied by the present invention.

It is further noted that additional cutting members can be used. For example, two diametrically opposite cutters can be used or two vertically spaced and aligned or circumferentially offset cutting members can be used. More than two cutting members can be used, such as for example in multiple pairs or other groupings of cutting members.

The cutting tool 18 shown in FIGS. 3–5 further comprises the setoff members 25. These members are disposed around the exterior of the sleeve 22 to space the sleeve 22 from the inner surface of the lining 6 and to engage the lining 6 to enable relative rotation between the mandrel 20 and the sleeve 22 when the cutting tool is disposed in the lining and moved to its cutting state as described above. That is, the setoff members 25 are sized and positioned to orient the cutting tool 18 at the correct distance from the lining 6 for the cutting member 24 to cut through the thickness of the lining 6 as the cutting tool 18 is pulled upward through the casing 2. The setoff members 25 are also sized and positioned to frictionally and with resilient force engage the lining 6 such that the sleeve 22 is held stationary relative to the lining 6 when the tool string is moved to rotate the mandrel 20 relative to the sleeve 22 for repositioning the slot 30 relative to the pin 32 and thereby moving the cutting member 24 to its extended, cutting position. Particular sizing provides a maximum outer diameter substantially equal to the inner diameter 8 of the lining 6, which diameter is known for particular sizes and weights of lined casing.

The setoff members of the embodiment shown in the drawings include first and second rigid members 25*a* (one is shown in FIG. 3 and the other is spaced around on the backside of the tool for the orientation of FIG. 3). The members 25*a* are circumferentially spaced from the cutting member 24 towards the opposite side of the sleeve 22 from where the cutting member 24 is connected to the sleeve 22. This opposing positioning provides firm support for the cutting action of the cutting tool 18. The supports 25*a* of the illustrated embodiment are made of square key stock held to the sleeve 22 by a plurality of screws (not shown).

As shown in FIG. 3, the setoff members 25 of the illustrated embodiment also include first and second resilient members 25*b* circumferentially spaced from the first and second rigid members 25*a* towards the side of the sleeve 22 where the cutting member 24 is connected to the sleeve 22. The members 25*b* of the illustrated embodiment in FIG. 3 are made of steel bow springs attached by screws 37 as represented in FIG. 3.

The members 25, or at least the members 25*a*, may not be needed for standoff or support in some instances. For example, if more than one cutting member is used in a particular tool, that tool may not need one or more of the illustrated setoff members 25.

Referring to FIGS. 6–10, a particular removal tool 44 and engagement members of the present invention will be described. In the preferred embodiment shown in FIGS. 6–10, inner and outer engagement members 46, 48 are included in the removal tool 44.

The illustrated inner engagement member 46 includes an inner body 50 that has a bulbous shape. This bulbous body 50 has an outer surface adapted to twist into the inner surface of the lining 6 in response to rotation of the bulbous body when the body is disposed in the lining 6. That is, the inner body 50 has outer surface means for twisting into an inner surface of the lining 6, which outer surface means includes a groove or ridge. In the illustrated embodiment this is defined by a thread 52 cut into the outer surface of the body 50. This thread extends at least around the maximum lateral diameter of the body 50. This maximum lateral diameter is less than the nominal inner diameter 8 of the lining 6 (i.e., the diameter 8 in the state illustrated in FIG. 1), but the maximum lateral diameter is large enough such that the thread 52 engages the inner surface of the lining 6 once the lining has been twisted to reduce the diameter 8 as described below. The thread 52 is in a direction that facilitates engaging and twisting the lining 6 given a direction that the bulbous body 50 is to be rotated.

Rotation of the bulbous body 50 occurs through rotation of a shaft 54 to which the bulbous body 50 connects. In the illustrated embodiment, the body 50 has a threaded stem 56 (FIG. 10) that screws into a mating threaded socket 58 formed in the shaft 54. The shaft 54 is also adapted to connect to the tool string for being moved into and out of the well and the casing 2. This connection to the tool string is through a connector hub 60 to which the upper end of the shaft 54 is threadedly connected as illustrated in FIG. 6.

Figure 12:
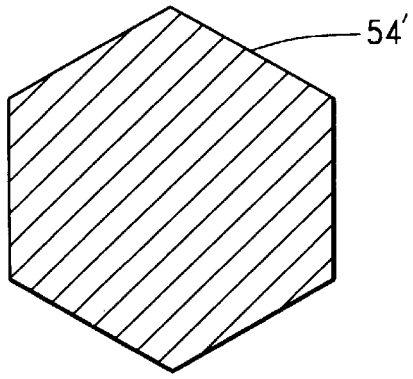
FIG. 12 is a cross-sectional plan view of a shaft having a different configuration from a shaft of the embodiment of FIGS. 6–10.

Another feature of the illustrated shaft 54 is that it includes at least one longitudinal groove 62 defined in its outer surface. This groove 62 enables the outer engagement member 48 to slide longitudinally relative to the shaft 54 but rotate with the shaft 54 when the shaft 54 is rotated, such as by conventional rotation of the connected tool string from outside the well. The sliding/rotating relationship between the outer engagement member 48 and the shaft 54 is achieved with a pin 64 (FIG. 7) mounted on the outer engagement member 48 and received in the groove 62 of the shaft 54 (FIG. 6). A preferred alternative to the pin/groove connection is to make the shaft 54 in a non-circular cross-sectional shape (e.g., a hexagonal shape such as illustrated in FIG. 12 for shaft 54') and to have a similarly shaped opening defined in the outer engagement member 48.

The aforementioned sliding/rotating relationship also connects the outer engagement member 48 with the inner engagement member 46 such that lining 6 is drawn into and held between the inner engagement member 46 and the outer engagement member 48 in response to rotating at least the inner engagement member 46 within the lining. This action occurs in the illustrated embodiment between the bulbous body 50 and a cylindrical body 66 of the outer engagement member 48. The cylindrical body 66 has an outer wall 68 (FIG. 7) defining an inner cavity. The outer wall 68 defines inner and outer diameters substantially equal to nominal inner and outer diameters 8, 10 of lining 6 shown in FIG. 1 (see also FIG. 6).

The outer engagement member 48 of the illustrated embodiment also includes a coupling element 70 (FIG. 7) to engage the shaft 54. The illustrated coupling element 70 is cylindrical with an axial bore throughout its length. The pin 64 is retained in the wall of the coupling element 70 but extends into the axial bore of the coupling element. If the shaft 54 has a hex or other non-circular cross-sectional shape, no pin 64 is needed and the shape of the bore in the coupling element 70 matches the shape of the shaft 54.

The coupling element 70 can remain connected to the shaft 54, but the cylindrical body 66 can be unthreaded from the coupling element 70 and replaced with another body of the same or a different size. To accommodate different sizes of cylindrical body 66, the bulbous body 50 can also be interchanged with others since the body 50 is threadedly connected to the shaft 54.

Figure 8:
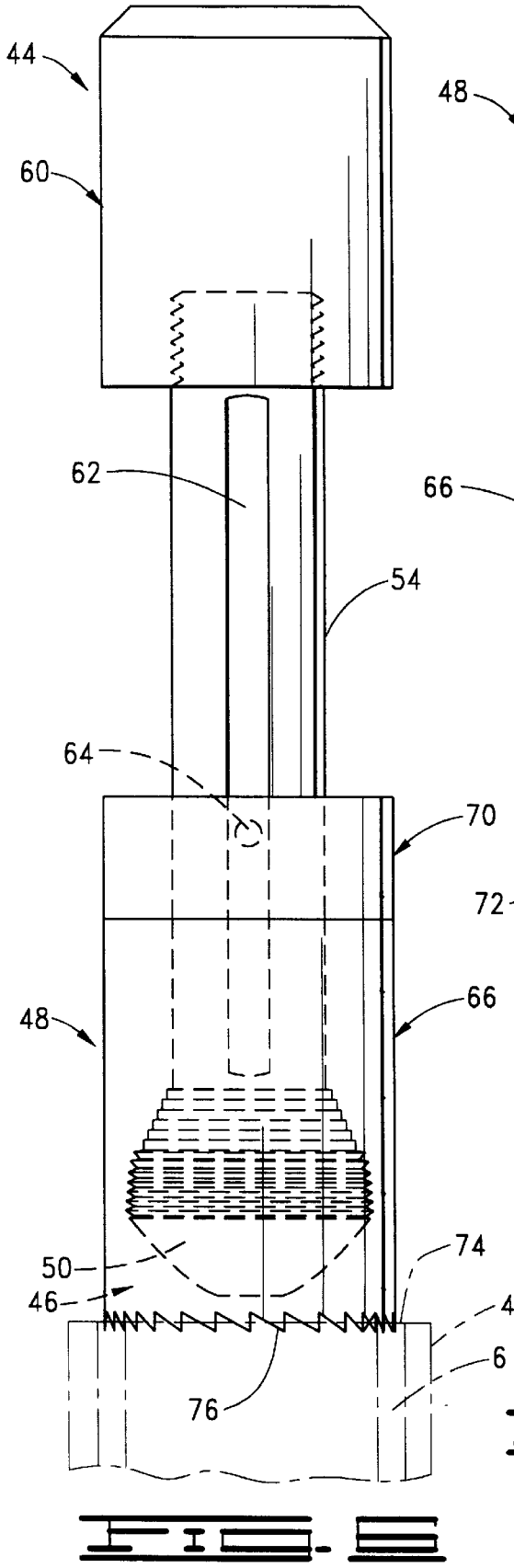
FIG. 8 is a view of a portion of a pointed element disposed along a lower end of the outer engagement member shown in FIGS. 6 and 7.
Figure 7:
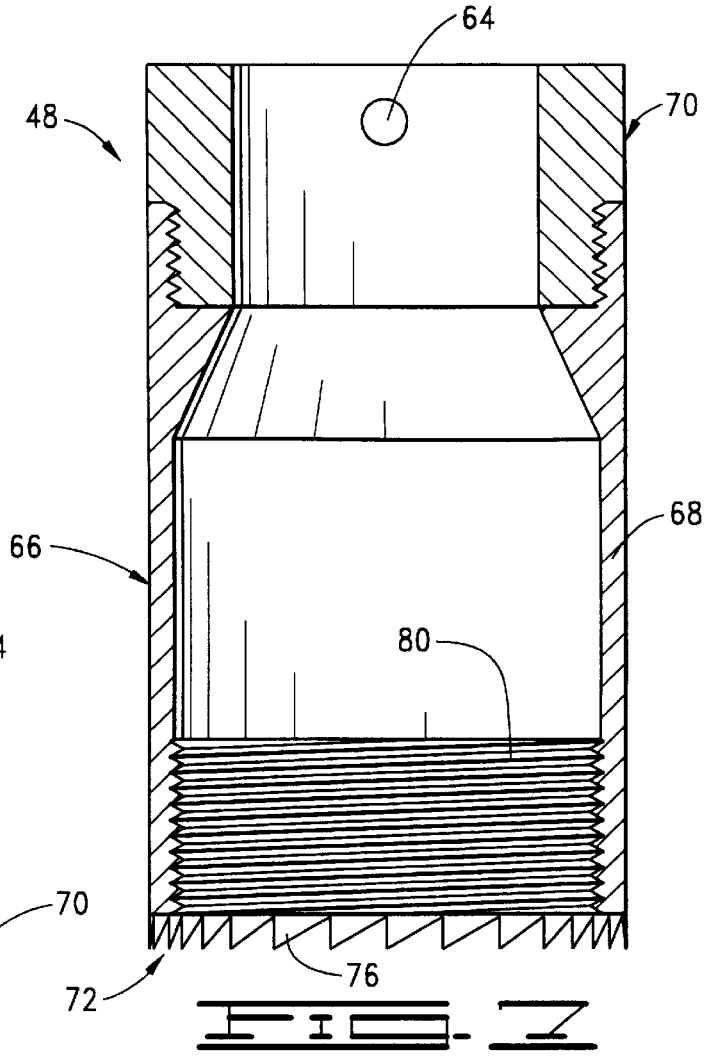
FIG. 7 is a cross-sectional elevational view of an outer engagement member of the removal tool shown in FIG. 6.
Figure 9:
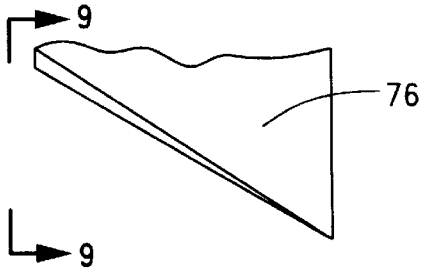
FIG. 9 is another view of the pointed element as taken along line 9—9 in FIG. 8.
Figure 5:
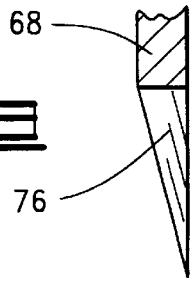
Figure 10:
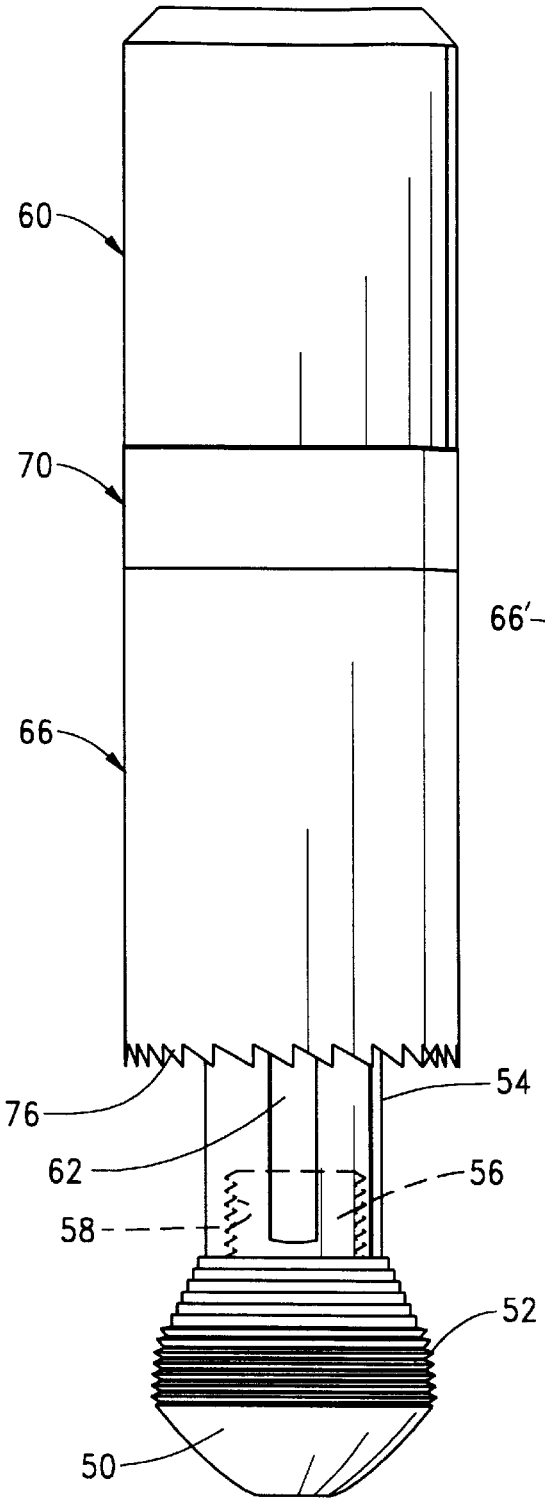
FIG. 10 is an elevational view showing the removal tool of FIG. 6 but with the inner engagement body extending below the outer engagement member.
Figure 11:
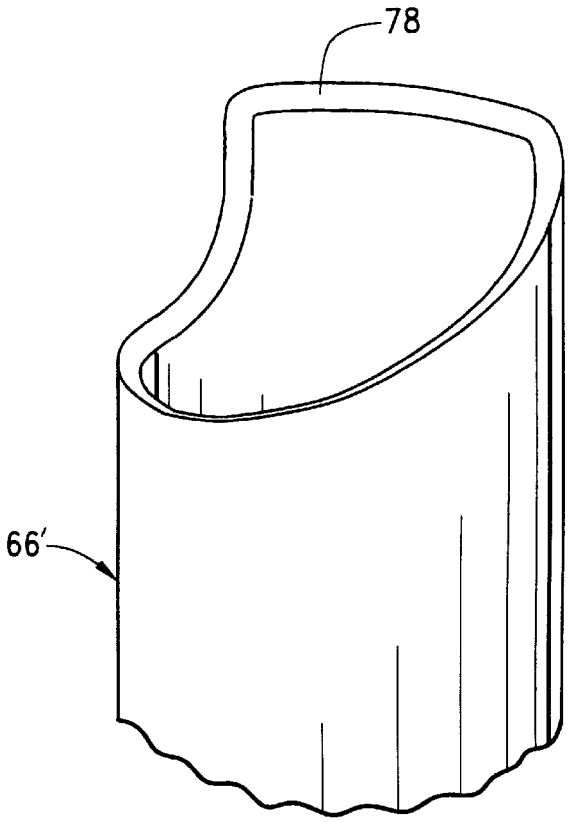
FIG. 11 is a view showing one alternative end surface for the outer engagement member.

Returning to the cavity element defined by the cylindrical body 66, the outer wall 68 terminates at a lower end 72. In the illustrated embodiment, the lower end 72 is adapted to cut into and engage a facing end surface of the lining 6 (e.g., end surface 74 marked in FIGS. 1, 2 and 6) (such an end surface can be defined by separating the support flange from the lining or by cutting off and removing an upper portion of the casing, for example). The lower end 72 shown in FIGS. 6, 7 and 10 has a circumferential row of sharp teeth 76. The teeth 76 are formed in the preferred embodiment so that the negative rake (i.e., the non-vertical angled) edges cut into and engage the lining 6 in response to the body 66 being rotated towards the negative rake (i.e., clockwise, as viewed from above looking down, for the illustrated configuration). Each of the teeth 76 has a tapered inner side that tapers to a flat or beveled lower edge as illustrated in FIGS. 8 and 9. Other lower edge configurations can be used. Another example is a "cut lip" edge 78 as illustrated in FIG. 11. It is also contemplated that the lower edge 72 can be flat with merely a frictional engagement between it and the edge of the lining 6 when the removal tool 44 is set down on the lining 6.

Still another feature of the cylindrical cavity body 66 is that the outer wall 68 has an inner surface in at least a portion of which a groove is defined. This groove is specifically a circumferential thread 80 cut into the inner surface in the illustrated embodiment. This thread helps draw and hold the lining 6 into the space between the bulbous body 50 and the outer body 66 when the removal tool 44 is rotated on and in the lining 6.

The removal tool 44 can be used in the following manner. It is attached to a tool string and lowered into the well in a conventional manner until the lower edge 72 engages the facing surface 74 of the lining 6 in the tubing 4 of the overall casing 2 disposed in the well (see FIG. 6). This engages the teeth 76, for the embodiment of FIGS. 6–10, in the material of the lining 6. The tool 44 is rotated, such as from the surface in a conventional manner or with a downhole motor. This twists a portion of the lining 6. As this portion twists, the inner diameter 8 of the lining 6 shortens to where the bulbous body 50 and the lining 6 contact each other. Continued rotation of the tool 44 twists the thread 52 into the lining 6, forcing the lining relatively upward so that it moves between the bulbous body 50 and the outer body 66. This preferably continues until the lining wedges and stalls or resists further rotation. The lining 6 is then held. This holding occurs due to the resulting wedging of the twisted portion of the lining 6 between the inner and outer engagement members of the tool.

With the lining 6 held in this manner by the removal tool 44, the removal tool is pulled out of the well, thereby pulling on the twisted and held portion of the lining 6 and extracting it from the tubing 4.

Preferably before the removal tool 44 is run into the well and used in the manner described above, the cutting tool 18 is run in and used to cut the lining 6. This is accomplished in a conventional manner as far as running the tool 18 into the well so that the tool 18 moves down through the lining 6 to the lowest point to be cut. The mandrel 20 is rotated (e.g., by rotating the tool string from the surface in a known manner) relative to the sleeve 22 held relatively stationary by the setoff members 25 engaging the lining 6. This rotation is sufficient to reposition the slot 30 relative to the pin 32 such that an upward pull on the mandrel 20 via the tool string moves the cutting tool 18 to the relative positions shown in FIG. 5, thereby extending the cutting member 24 to cut into the plastic material of the lining 6. Continued pulling on the mandrel 20 (with a force sufficient to overcome any anti-vertical-movement holding force of the setoff members) draws the extended cutting member 24 upward to cut the lining along a vertical line to form the longitudinal cut 12 illustrated in FIG. 2. The resulting cut preferably is beveled at an angle to respond to the rotation of the removal tool 44 as described above.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A system for removing lining from tubing in a well, comprising:

a cutting tool having a cutting member to cut lining while the lining is in tubing in the well; and a rotatable removal tool to engage the cut lining in the well such that a portion of the cut lining is twisted into engagement with the removal tool for extraction from the well with extraction of the removal tool from the well.

2. A tool system for a well, comprising:

a cutting tool having a cutting member adapted to form a beveled cut through a thermoplastic polymer wall of a lining along a length of the lining as the cutting tool disposed in a cutting mode is pulled through such length of the lining, the lining disposed in a metal tubing in the well; and a removal tool adapted to twist into and hold the cut thermoplastic polymer wall such that the cut thermoplastic polymer wall is removed from the tubing in response to pulling the removal tool out of the well.

3. A method of removing lining from tubing in a well, comprising:

cutting lining disposed in a tubing disposed in a well;

rotating an inner retaining body into an inner surface of the cut lining; and pulling on the inner retaining body to remove the cut lining from the tubing.

4. A method of removing from tubing in a well a lining made of thermoplastic polymer, comprising:

cutting the thermoplastic polymer;

engaging the cut thermoplastic polymer, including twisting a portion of the cut thermoplastic polymer and holding the twisted portion; and extracting the cut thermoplastic polymer from the well, including pulling on the twisted and held portion of the cut thermoplastic polymer.

5. A cutting tool for a well, comprising:

a mandrel;

a sleeve mounted on the mandrel such that there is selectable relative movement between the mandrel and the sleeve; and a cutting member connected to the sleeve such that the cutting member is in a retracted position when the mandrel and the sleeve are in a first relative position and such that the cutting member is in an extended position when the mandrel and the sleeve are in a second relative position, wherein the cutting member has a width and a cutting edge of angular disposition sufficient to form a beveled cut through a plastic lining in a tubing in the well where the cutting tool is pulled through the lining with the cutting member in the extended position.

6. A cutting tool as defined in claim 5, wherein the mandrel includes:

an adapter body to connect to a tool string; and an actuator body having an angled surface to engage the cutting member and move the cutting member to the extended position.

7. A cutting tool as defined in claim 6, wherein the angled surface has an upper portion closer to a longitudinal axis of the mandrel than is a lower portion of the angled surface.

8. A cutting tool as defined in claim 5, further comprising setoff members disposed around the exterior of the sleeve to space the sleeve from the lining and to engage the lining to enable relative rotation between the mandrel and the sleeve when the cutting tool is disposed in the lining.

9. A cutting tool as defined in claim 8, wherein the setoff members include:

first and second rigid members circumferentially spaced from the cutting member towards the opposite side of the sleeve from where the cutting member is connected to the sleeve; and first and second resilient members circumferentially spaced from the first and second rigid members towards the side of the sleeve where the cutting member is connected to the sleeve.

10. A cutting tool as defined in claim 5, further comprising:

first and second rigid members circumferentially spaced from the cutting member towards the opposite side of the sleeve from where the cutting member is connected to the sleeve; and first and second resilient members circumferentially spaced from the first and second rigid members towards the side of the sleeve where the cutting member is connected to the sleeve.

11. A cutting tool as defined in claim 10, wherein the mandrel includes:

an adapter body to connect to a tool string; and an actuator body having an angled surface to engage the cutting member and move the cutting member to the extended position.

12. A cutting tool as defined in claim 11, wherein the angled surface has an upper portion closer to a longitudinal axis of the mandrel than is a lower portion of the angled surface.

* * * * *